US005538291A

United States Patent [19]

Gustafson

[11] Patent Number: 5,538,291

[45] Date of Patent: Jul. 23, 1996

[54] ANTI-THEFT CREDIT CARD

[76] Inventor: Ulf Gustafson, 126 Honey Lake Rd., North Barrington, Ill. 60010

[21] Appl. No.: 312,787

[22] Filed: Sep. 26, 1994

[51] Int. Cl.[6] ..... B42D 15/00

[52] U.S. Cl. ..... 235/487; 235/493; 283/904

[58] Field of Search ..... 235/486, 487, 235/488, 492, 493; 283/904

[56] References Cited

U.S. PATENT DOCUMENTS

| | | | |
|---|---|---|---|
| 3,434,414 | 3/1969 | Wright | 283/904 |
| 3,505,954 | 4/1970 | Projansky | 283/904 |
| 3,511,181 | 5/1970 | McGiffen | 283/904 |
| 3,583,317 | 6/1971 | Gibson | 283/904 |
| 3,605,619 | 9/1971 | Gilstrap | 283/904 |
| 3,650,210 | 3/1972 | Archer | 283/904 |
| 4,643,453 | 2/1987 | Shapiro et al. . | |
| 4,896,027 | 1/1990 | Drexler | 235/488 |
| 4,931,629 | 6/1990 | Frankfurt . | |
| 5,095,194 | 3/1992 | Barbanell . | |
| 5,163,098 | 11/1992 | Dahbura . | |
| 5,180,902 | 1/1993 | Schick . | |
| 5,239,166 | 8/1993 | Graves . | |
| 5,251,259 | 10/1993 | Mosley . | |
| 5,255,941 | 10/1993 | Solomon . | |
| 5,259,649 | 11/1993 | Shomron . | |
| 5,284,364 | 2/1994 | Jain . | |
| 5,288,979 | 2/1994 | Kreft . | |
| 5,326,964 | 7/1994 | Risser | 235/486 |

*Primary Examiner*—Harold Pitts
*Attorney, Agent, or Firm*—Lawrence J. Chapa

[57] ABSTRACT

The invention is an improved credit card utilizing a die-cut removable portion which enables both visual and/or mechanical disablement of the card. The die-cut portion is preferably in the shape of a conventional key providing a visual indicator of the missing link necessary to make the card operational. The die-cut portion of the card may encompass identifying indicia such as the owner's name, the card expiration date, the numerical identification number, and/or the magnetic strip. Variations of the die-cut key allow certain aspects of the card to remain enabled should the removed key be accidentally lost. The invention requires that the key lock system be carried separately from the credit card thus frustrating pick-pockets or instances where the cards are otherwise stolen or lost. A second embodiment of the invention includes the use of the die-cut portion placed within two side surfaces of a credit card device. A portion of the card is transparent so as to provide visual indication of the key position within the card. An attachment device is further provided for securing the removed die-cut portion to a key ring or necklace providing ease of accessibility for reinsertion into a card member.

13 Claims, 3 Drawing Sheets

ANTI-THEFT CREDIT CARD

FIELD OF THE INVENTION

This invention relates to the prevention of credit card fraud, and more particularly to a credit card having a removable portion which can be carried separately providing an anti-fraud credit card that is simple to use, economical to manufacture, and highly effective in preventing misuse.

BACKGROUND OF THE INVENTION

The increasing use of credit cards throughout the world is an economic trend that indicates financial transactions rely more upon credit card use than any other type or form of payment. Credit cards are now accepted in grocery stores, fast food chains, colleges and universities. Even the U.S. Government now accepts income tax payments by credit card. This phenomenal growth of credit card use is predicted to reach approximately one trillion annual transactions by the year 2000.

Credit cards originated as an indicator that its owner is entitled to credit when purchasing goods or services from certain establishments. The credit card originated in the United States in the 1930's and by 1950 became commonly accepted. When a credit card is used, a retailer records the name, account number of the purchaser, and the amount of the sale and forwards this record to the credit card billing office. Due to the amount of credit card theft or fraud it is now common place for the retailer to telephone a clearing house to verify card authenticity and determine if the owner is entitled to as much credit as they request. At intervals, typically monthly, the billing office will send a statement to the card owner listing all of the charged purchases and requesting payment. The billing office then reimburses the retailer directly. Thus, if an unscrupulous person obtains the credit cards of a reputable person, the thief may continue to do business with a retailer and obtain goods based on the credit card good standing.

Corporations have also found the benefit of backing credit cards, as in the success of the GM card which provides discounts on automobiles in relation to how much has been charged against the card. Similarly, most department stores now offer credit cards. In light of the proliferation of membership benefits, all affinity programs continue to change consumer spending behavior by encouraging card usage.

Credit card fraud at current levels now cost the industry over one billion dollars per year. For these reasons all credit card companies have launched various ownership verification programs to help reduce the amount of fraud. Thus, the primary problem with credit cards in their use is the ease of and enormous amount of credit card fraud.

In European markets technologies have been incorporated wherein credit cards are further protected by an embedded integrated circuit. However, in light of the millions of credit cards produced each year, the insertion of an integrated circuit into each card adds a tremendous expense. The most widely known use of the IC embedded card is in Europe and coined "Smart Cards." The cards are being spearheaded by the French banks who want the world banking industry to adopt their technology to help fight credit card fraud. Opponents to the Smart Card object to the high cost, pointing out that they may be very appropriate in France where high telecommunication charges are an obstacle to traditional credit card verification. However, the United States telecommunication charges are very low allowing traditional telephonic credit card verification. Thus, the cost of implementing smart cards for use in the United States is astronomical as the infra-structure is not in place to support such technology.

Numerous credit card anti-fraud devices have been introduced. U.S. Pat. No. 5,180,902 sets forth a self-verifying transaction card having a key pad for entering a personal identification code. This disclosure sets forth an IC embedded programmable chip that requires comparison of an entry code with a stored code wherein failure to provide the proper entry will serve to disable the card from further identification functions and transactions.

U.S. Pat. No. 5,163,098 sets forth an IC embedded credit card using an encrypted algorithm which must be verified by the card holder after the merchant has generated a receipt which requires deciphering of the encryption. A main disadvantage of this device is its requirement for a central data base.

U.S. Pat. No. 5,095,194 is directed to a holographic credit card which requires a unique identification such as a fingerprint of the authorized user to permit use of the credit card. The credit card requires a registering device for scanning of the fingerprint of the card holder versus the fingerprint embedded on the credit card.

U.S. Pat. No. 4,643,453 sets forth a credit card security system requiring the merchant to finalize a credit card purchase by adding an auxiliary character on the bank copy of the credit card slip. This form of credit card is directed to protection of the numbers which are embedded on the charge slip.

U.S. Pat. No. 4,931,629 also sets forth a security credit card containing at least one distinctive gem wherein the distinctiveness of the gem is recorded against the name of the proper credit card owner. A number of flaws can be noted in application of this invention, most notable of which is the expense of placing a gem within each credit card.

U.S. Pat. No. 5,239,166 sets forth an interchange system for use with credit cards which again relies upon the use of a scanner for verification of fingerprints.

U.S. Pat. No. 5,251,259 sets forth a unique personal identification system which relies upon a personal identification number that the individual must memorize based upon a specific sequence changing each calendar day.

U.S. Pat. No. 5,255,941 sets forth yet another credit card assembly which relies upon the information set forth in a magnetic strip on the face of the credit card utilizing a slide rule type presentation which permits selective changing of information to a particular machine.

U.S. Pat. No. 5,259,649 sets forth a sequencing of numbers which requires the rightful owner to remember the correct identification code in order for the card to operate.

U.S. Pat. No. 5,284,364 provides a security system for credit cards utilizing a photographic display of information readable only under a polarizing viewer. The holder of the card may be required to recite certain personal information supposedly known only to the holder of the card. Obviously a drawback to this invention is the need for placing additional personalized information on a credit card.

U.S. Pat. No. 5,288,979 sets forth yet another use of an embedded IC placed within a credit card requiring activation of the chip in order to release information provided by the credit card. This provides a contact list interface where the energy is provided by an external source in order to make the IC operational. The result is a data transmission from the credit card to the reader.

A couple of the largest credit card companies, namely, Visa and MasterCard have recently launched card ownership verification programs and have started development using holographic magnetic technology for magnetic strip protection. By combining such technology with personal identification numbers (PIN) they have estimated that they reduce credit card fraud by as much as seventy-five to eighty percent. The PIN number requires a user to insert a number before a transaction can begin and is commonly used in automatic teller machines so as to prevent stolen cards from use. Hollow magnetic technology further reduces the problem of counterfeiting of cards as there is currently no known way to copy the technology.

Thus, it would appear that the industry is now leaning towards the use of the costly Smart Card as its support within the banking industry and corporate America is beginning to grow. However, the Smart Card remains significantly more costly to produce than a single magnetic strip card as each card requires an integrated circuit. More importantly, at this time there is no infra-structure necessary to support the Smart Cards as each location will be required to have a card reading terminal capable of obtaining information from the integrated circuit. For this reason the existing payment card infra-structure now in place for magnetic stripped cards is extremely valuable. Should a device be made available that could curtail credit card fraud by eliminating the need of going to the Smart Card technology, it most certainly would be immediately welcomed. In those instances that the Smart Card is operational, the instant invention provides a means for visually disabling the Smart Card.

Thus, what is needed in the art is a device that works with present day card reading technology available throughout the world and further provides an inexpensive means for the reduction of credit card fraud and associated counterfeiting; and further provides a means for updating of a credit card without the need for replacement of the entire card.

SUMMARY OF THE INVENTION

The instant invention is a disabling device for credit cards based upon die-cutting a portion of the card. A primary embodiment of the instant invention is based upon a conventional card wherein a key shaped portion is die-cut from the credit card thereby disabling the credit card for use except when the portion is placed within the credit card. For example, a portion of the credit card that is die-cut would encompass at least one of the necessary verification items such as the expiration date or a portion of the identification number wherein a person asked to consummate a transaction having such verification removed would have an instant indicator that the transaction is afoul. Further, the transaction cannot be accomplished, as the necessary information is lacking in order to complete the transaction. Alternatively, the card could be cut in half, either in the flat plane or perpendicular thereto. An optional key ring attachment mechanism allows the die-cut portion to be releasably secured thereto and carried along with an individual's conventional keys.

The die-cut portion of the card is preferably in the shape of a key. The key shape makes it extremely difficult for a counterfeiter to duplicate the shape when used in accordance the invention since portions of the stripe and/or other verification parts are thereby removed so as to discourage counterfeiters from duplicating. Further, the key shape is an age old indicator providing instant conceptualization of a locking mechanism. It should be noted that the die-cut portion can be any section of the card, the intent of which is to provide a visual disablement of the card.

The use of a die-cut removable section will allow the manufacturer of the credit card to update a card by simply replacing the die-cut section with a new section having updated information, i.e. expiration date. In this fashion replacement sections can be provided in lieu of replacement credit cards thus lowering the cost of manufacture and lessening the burden on resources. The removable section could include a portion of the magnetic strip.

Another embodiment of the instant invention is to provide a die-cut removable section which would be insertable between the two side surfaces of the credit card. In this embodiment, the removable section could be made of such stature that it would slide between the side surfaces wherein a transparent side surface would allow matching lines such as bar coding or logos so as to provide a visual indication that the inserted section belonged to the rightful owner. An advantage of the instant invention is necessity to carry the activating device and credit card in two separate locations. Thus, if a wallet is stolen the thief would not have access to the activating device. If a set of keys are misplaced, the keys will not provide sufficient activation or information for counterfeiting of a credit card.

Another embodiment of the instant invention is to have a credit card having two plates which can be disengaged for insertion of an activating key like device. In this embodiment, the magnetic strip or key shaped cutout can be placed within the two side surfaces providing visual as well as computer readable indication that the credit card is in one piece and carried by its rightful owner.

The advantage of the die-cutting invention is that no alteration to card size must be made for the preferred embodiment and no additional equipment or data base information need be required to make the device operational. The locking mechanism fits within the card allowing it to operate within current card reading devices.

The instant invention works well with both male and female persons despite their diverse ways in carrying of credit cards wherein a man typically utilizes a wallet placed in a pocket separate than his keys while a woman would place her wallet in a purse, in many instances in the same location as her keys. Thus, should a man be pick-pocketed the separate die-cut key sections would be with his keys secured within another pocket. For women, a common method of purse snatching is while the woman is driving, a thief will smash a car window and grab the purse as it sits on a passenger seat. In this instance, the locking mechanism for the credit cards would be in her ignition switch, thus separate from the purse. In instances where a woman is walking from a shopping mall to her vehicle, it is common practice to have the keys removed from the purse wherein the remote door opener, panic button or self-protection device such as mace is attached to the key ring thus separated from the purse. Should the female be approached in such a situation the thief is most likely trying to steal the purse which would have the disabled credit cards placed within. Alternatively, the key ring attachment mechanism can be used in combination with a necklace wherein the key shaped sections can be concealed beneath a woman's blouse. The removable section can be made to form distinctive silhouette of any person, place, or thing providing a collectors type necklace.

The holding mechanism can accommodate multiple die-cut sections should the woman be carrying numerous credit cards. It is further contemplated that the die-cut key lock can be personalized to an individual owner and be used with multiple credit cards thus requiring the person to carry only one such key lock portion with them at any time. It is noted that the necklace is not particular to the female, as a male may also use the attachment mechanism in combination with a necklace. Further, the size of the key lock removable sections allow for concealment in such areas as money belts and, due to the use of light weight plastic, insertion into pockets sewn in socks, pants, dresses, and so forth.

Thus, a primary objective of the instant invention is to disclose precision die-cutting of a portion of a magnetic strip, embossed numbers, signature line, or a combination of all the above so as to provide a credit card that can be enabled or disabled by the addition or removal of the die-cut portion of the card.

Another objective of the instant invention is to teach the use of a die-cut portion of the card that is in the shape of the key so as to provide enhanced protection by taking the shape of a conventional lock mechanism that is difficult to replicate.

Yet another objective of the instant invention is to eliminate the need for more expensive anti-fraud features such as embedded integrated circuits, holograms, and fingerprint readers which are expensive to manufacture and difficult to maintain, further allowing the use of card reading devices currently used throughout the world.

Yet still another objective of the instant invention is to achieve a press fit lock system allowing the user of the credit card to "snap" the enabling die-cut portion into place.

Another objective of the instant invention is to incorporate an attachment ring that will hold the enabling key to a conventional key chain.

Still another objective is to teach the use of a replaceable section to an existing credit card so as to allow updating of a credit card without total replacement of the card.

Another objective is to provide die-cuts that are distinctive silhouettes that are decorative and can be worn concealed beneath a shirt when used in conjunction with a necklace.

Other objectives and advantages of this invention will become apparent from the following description taken in conjunction with the accompanying drawings wherein are set forth by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Although the invention will be described in terms of a specific embodiment, it will be readily apparent to those skilled in the art that additional modifications, rearrangements and substitutions can be made without departing from the spirit of the invention. The scope of the invention is defined by the claims appended hereto.

Figure 1:
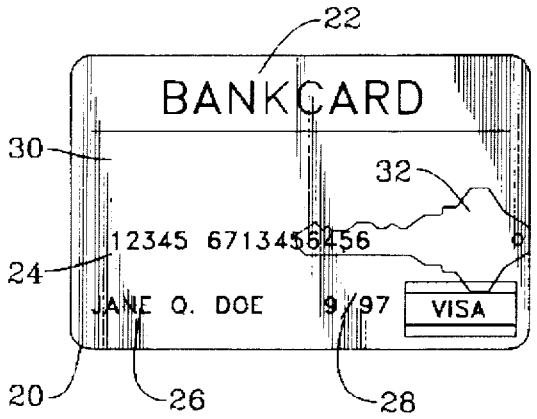
FIG. 1 is a pictorial view of a conventional credit card with a die-cut key disposed within the center of the card.

Now referring to FIG. 1 shown is a conventional shaped credit card 20 having identifying indicia such as the name of the card issuer 22, a numerical number 24 assigned to the credit card owner, the name of the credit card owner 26 and the expiration date 28. In this embodiment a portion of the card surface 30 is die-cut in the shape of a key 32 wherein removal of the key provides a visual indicator that the card is inoperable for conventional credit card transactions relying upon human interface. However, it is noted that in this embodiment the magnetic strip located on the back side of the card is kept intact wherein the card can still be utilized for transactions wherein human interface is not required such as in the use of a gas pump or the like device which relies solely upon the magnetic strip for obtaining of information necessary to complete the transaction. Such transactions do not rely upon human interface and typically allow only de minimis amounts of money due to the lack of transactional verification.

It should be noted that any die-cut configuration can be used to disable the credit card including but not limited to the removal of the card logo or a printed area such as the signature line or expiration date. Such removal is intended to provide the recipient of a transaction a direct indication that the holder of the card is not necessarily the owner of the card without presentation of the enabling key. Further, by removal of a critical portion of the card, the person expected to complete the transaction will not have sufficient information in order to complete the transaction.

Figure 2:
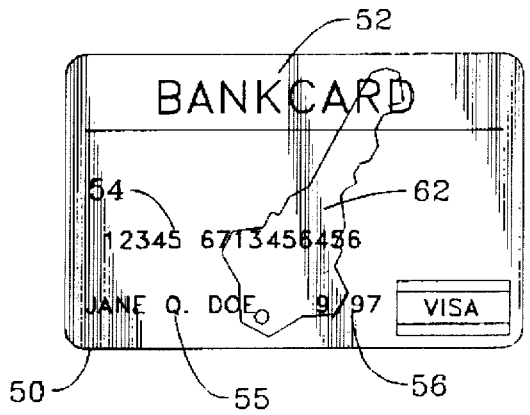
FIG. 2 is a pictorial view of a credit card wherein the die-cut key is placed across critical portions of the credit card including the magnetic strip.
Figure 2A:
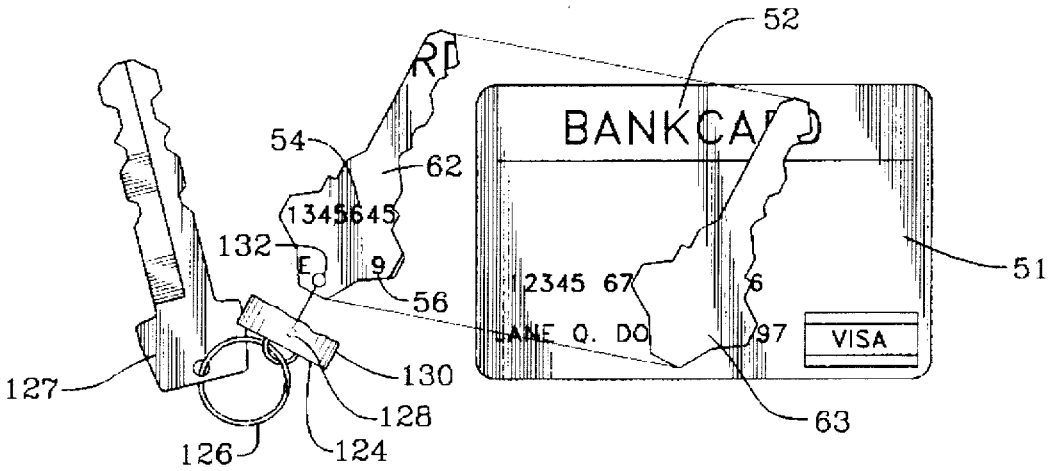
FIG. 2A is a pictorial view of FIG. 2 wherein the die-cut key is removed from the credit card providing a through hole cavity, the key available for attachment to a conventional key ring.
Figure 2B:
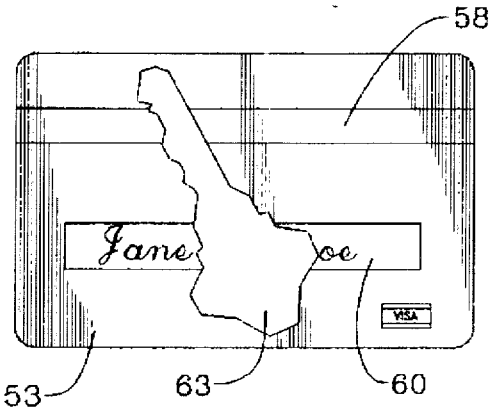
FIG. 2B is a rear pictorial view of FIG. 2A wherein the removal of a portion of the magnetic strip and name line is shown disabled.

FIGS. 2, 2A and 2B illustrate a conventional shaped credit card 50 having a first face 51 and a second face 53. Identifying indicia includes the card issuer 52, the identification numbers 54, card owner 55, the date of expiration 56, the magnetic strip 58 and signature line 60 found on the back side of the card. Key 62 is cut from the card 50 wherein removal of the key 62 leaves a through hole 63 so as to disable the magnetic strip 58, and further remove critical portions of the card including a portion of the numerical number 54, the date of expiration 56, and a portion of the signature line 60. Thus, the removal of the key lock 62 disables the operation of the credit card for use with card reading devices and further provides a visual indication that the card is not operational.

The credit card can be updated by replacement of a key 62 having updated information. For instance, the expiration date 56 can be updated by mailing to the card holder a new key 62 with the updated expiration date. The key 62 can further be made universal to fit all the cards owned by the card holder or for a particular card line wherein an attempt by a counterfeiter to put in a substitute key would have to contain not only the appropriate missing information, that can be verified telephonically, but also the key must align with the remaining logo or the like indicia currently on the credit card. Thus, similar to the issuance of license plates which at one time were replaced each year, license plates for today's automobiles are used for many years and simply updated by a sticker. Following in this format, the instant invention provides for a credit card that is usable for many years thus decreasing the amount of waste and expense of the card which offsets the cost of die-cutting the key.

It is well known that the magnetic strip includes pertinent information, some of which may need to be updated however, failure to update the magnetic strip would only serve to allow de minimis transactions that rely solely upon the strip and not verified by human interface. With the key 62 removed from the surface of the card, the cavity 63 provides an instant indication to the proposed recipient that the card is not available for transactions. The shape of the key 62 is made fractionally larger than the cavity 63 to allow for press fitting into the cavity.

Referring in particular to FIG. 2A, separated support of the key 62 is made possible by use of an engagement mechanism 124 attachable to a conventional key ring 126 shown with a car key 127. The attachment mechanism 124 may consist of a biasing friction fit thereby positioning the key 62 in a secure position, the biasing of the clip can easily accommodate five key locks without slippage. Alternatively, the holding device 124 may include a U-shaped holder that is biased in a closed position having an insertion tab 128 available for grasping through hole 132 located on the key 62. In operation the key 62 would be inserted into the holding device 124 wherein the engaging tab 128 would latch to the through hole 132 securing the card in place when it is held external the credit card. Removal of the key from the holding device 124 would be accomplished by squeezing each side of the holding device 124 thus biasing the device in an open position wherein the engaging tab is released from the through hole 132 thereby allowing the key to be removed and placed into its credit card application.

Figure 3:
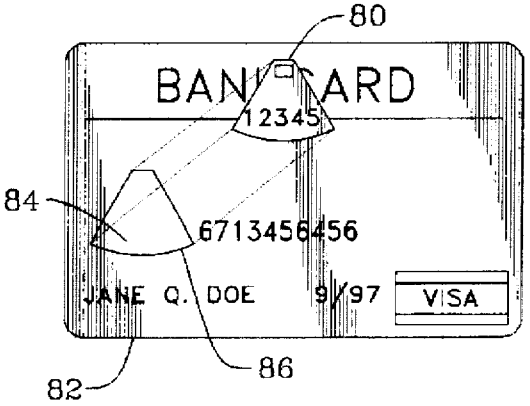
FIG. 3 is a pictorial view of a die-cut shape wherein the back face of the card member remains intact.

Now referring to FIG. 3, a key 80 is shown for use with credit card 82 having a backing sheet 84 forming a base to the key insert section. The key 80 is inserted into the cavity 86 wherein the backing sheet 84 prevents the key from being placed through the entire side of the card. The cavity can be formed by routing of a ghost image of the key by use of a three-axis computer operated routing machine which can place a cavity at a depth of approximately twenty-five to thirty thousandths of an inch thick, thus retaining a thin platform along the backside 84 so that excessive pressure during insertion of the die-cut key would prevent the key from passing through the opening of the card. It should be noted by this figure that the shape of the cut-out is not limited to a key but can be of any silhouette. The removal of any key lock is performed by flexing of the card member wherein the flexing twists the key out of the card.

Figure 4:
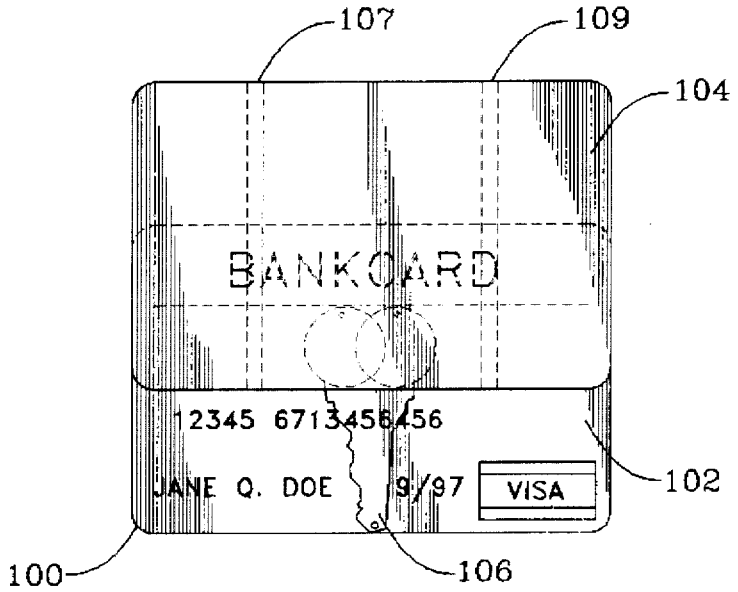
FIG. 4 is a pictorial view of another embodiment of the die-cut key lock using a slidable cover placing the key between two side surfaces.
Figure 5:
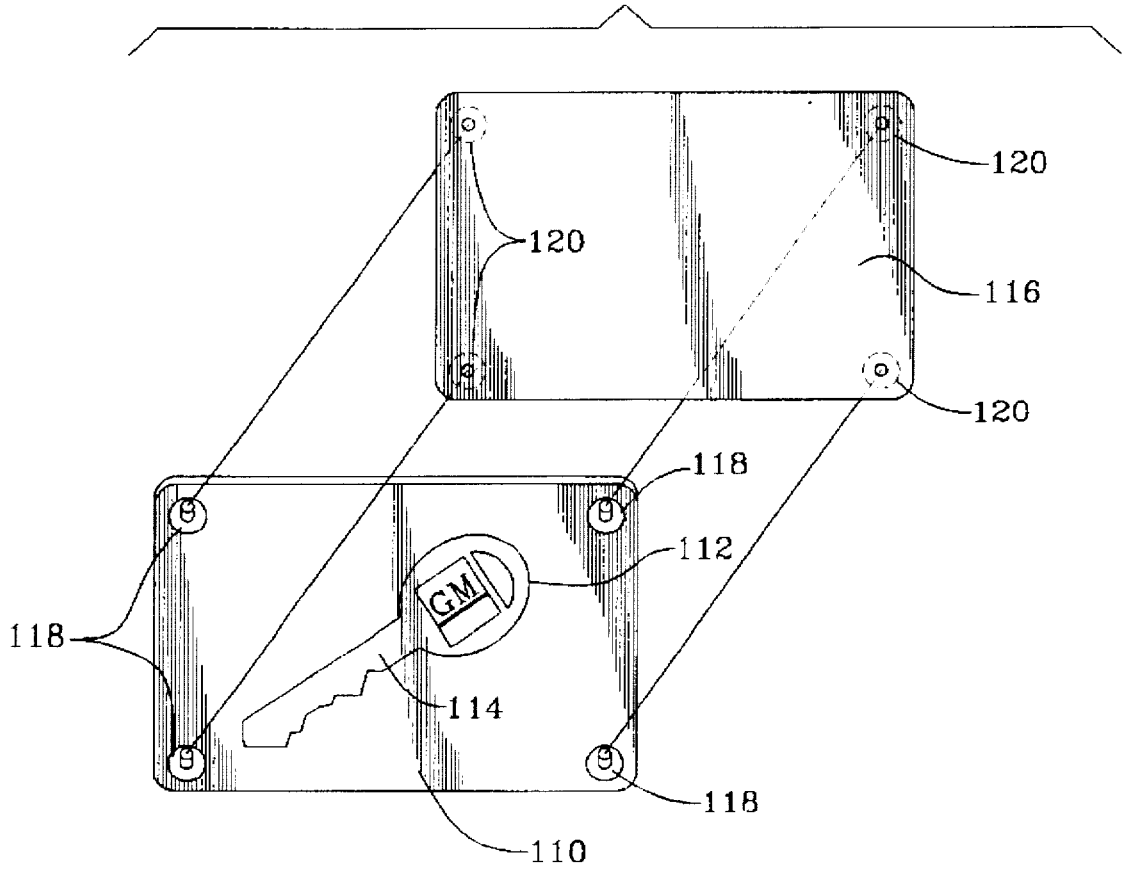
FIG. 5 is a pictorial view illustrating the key placed between two side surfaces using parameter locking tabs.

In FIG. 4 shown is a second embodiment of the instant invention wherein the credit card 100 is constructed of two separate pieces of plastic defined by lower support structure 102 and upper support structure 104. In operation a key 106 is placed within the lower support structure 102 in a similar manner as described above and in particular in reference to FIG. 3 wherein a backing sheet is maintained in the lower structure. The cover 104 of the card is then available to slide over the lower structure by the use of integral guide rails 107 and 109 so as to position the cover directly over the base so as to provide the look of a conventional credit card. The key 106 can be seen through the cover 104 which is transparent thereby providing instant verification that the card is operable. A subset of this embodiment can further be found in FIG. 5 wherein the lower structure 110 includes the aforementioned cutout 112 for receipt of a die-cut key 114. The upper structure 116 is then releasably coupled to the lower structure 110 by use of engagement tabs 118 located around the perimeter of the lower structure 110 wherein the upper structure 116 includes accommodating engagement slots 120 receptive to the protruding tabs 118 for securing the key 114 between the two structures. Similar to the aforementioned embodiment, the cover 116 is transparent providing instant visual indication that the credit card is now operable.

Figure 6:
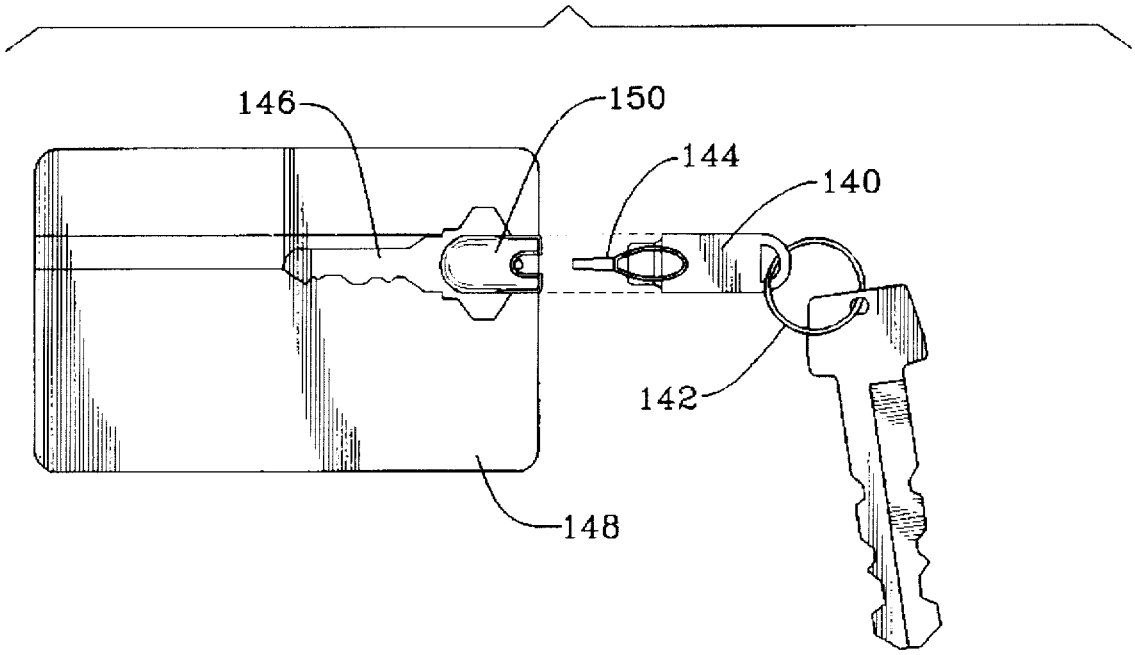
FIG. 6 is a pictorial of an attachment device for holding of the key upon removal from a credit card position.

As shown in FIG. 6 an alternative embodiment employs an external key 140 that is attached to a conventional key ring 142 having an interlocking portion 144 which couples to the key 146 placed within the card 148. The key 146 includes a receptive interlocking portion 150 providing a visual indicator that the owner is present by the interlocking of key lock 140 to the key 146.

Figure 7:
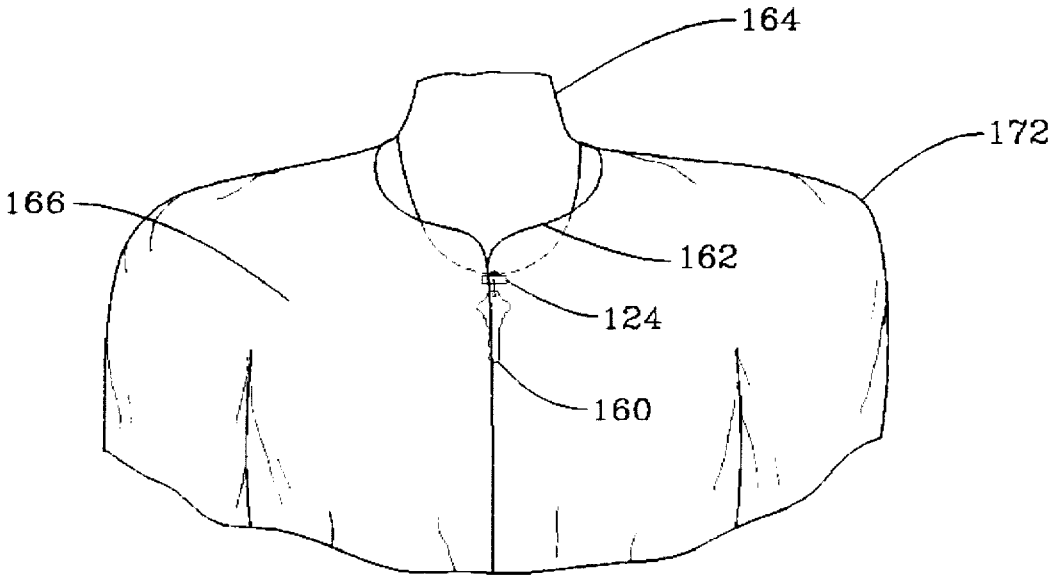
FIG. 7 is a pictorial of a key lock concealed beneath and article of clothing.

FIG. 7 illustrates a means for concealing of a lock key 160 on a human 172 by placement of the key on a necklace 162 about the persons neck 164. The key latch mechanism is described in detail by reference to FIG. 2A which allows the key to be concealed beneath clothing 166. By this pictorial, it is disclosed that the key ring attachment mechanism can be used in combination with a necklace wherein the key shaped sections can be concealed beneath a clothing. The holding mechanism can accommodate multiple die-cut sections so as to entertain numerous credit cards.

It is to be understood that while we have illustrated and described certain forms of our invention it is not to be limited to the specific forms or arrangements or parts herein described and shown. It will be readily apparent to those skilled in the art that various changes may be made without departing from the scope of the invention and the invention is not to be considered limited to what is shown in the drawings and described in the specification.

What is claimed is:

1. A fraud resistant credit card defined by a base constructed from a substantially rectangular flat piece of plastic having a first and second face forming a first width, said first and second faces having identifying indicia placed thereon including the card issuer, numeric identification of the card owner, and a magnetic strip bearing magnetic information presentable to consummate a financial transaction, the improvement comprising: cutting a section from said card member, said section encompassing a portion of said identifying indicia and a portion of said magnetic strip and removable therefrom so as to separate a portion of said identifying indicia and a portion of said magnetic strip from said card member for disablement of said card member; and means for securing said removable section to said card member for enablement of said card member.

2. The card member according to claim 1 wherein said removable section is cut by means of a die-cutting device.

3. The card member according to claim 1 wherein said removable section assimilates the shape of a conventional door key.

4. The card member according to claim 1 wherein said removable section forms a distinctive silhouette.

5. The card member according to claim 1 wherein said removable section encompasses a portion of said magnetic strip for card reader disablement of said card member.

6. The card member according to claim 1 wherein said removable section is further defined as a cavity, said cavity cut from one of said first and second faces by means of a routing process providing a cavity having a depth less than the width of said card member.

7. The card member according to claim 1 including a transparent cover having a means for securing to said base thereby securing said removable section therebetween.

8. The card member according to claim 7 wherein said means for securing is defined as at least one integrated rail for slidably engaging said cover to said base.

9. The card member according to claim 7 wherein said means for securing is defined as a plurality of tabs extending from said base, said cover having corresponding engagement slots for securing said tabs in a fixed position thereby securing said removable section between an inner surface of said cover and said first face.

10. The card member according to claim 1 including an attachment mechanism available for coupling at least one removable section to an object worn or carried by an individual.

11. The card member according to claim 10 wherein said means for coupling is further defined as a biasing clamp releasably engagable to a through hole disposed in said removable section.

12. The card member according to claim 10 wherein said means for holding said key includes an interlock insertable into one end of said removable section to provide a visual indicator of matching components.

13. A fraud resistant credit card defined by a substantially rectangular flat piece of plastic having a first and second face forming a first width, said first face having identifying indicia placed thereon including the card issuer, numeric identification of the card owner, said second face including a magnetic strip bearing magnetic information presentable to consummate a financial transaction, the improvement comprising: die-cutting a section from said card member in the shape of a conventional key, said section encompassing at least a portion of said identifying indicia and removable therefrom so as to separate said identifying indicia from said card member for visual disablement of said card member, said removable section including a through hole disposed near one end of said section; and a clasp securable to a key ring, said clasp having a biasing means with an engagement tab operatively associated with said through hole for releasably securing said removable section to said key ring.

* * * * *